US005129841A

United States Patent [19]

Allina et al.

[11] Patent Number: 5,129,841

[45] Date of Patent: Jul. 14, 1992

[54] PLUG-AND-JACK ELECTRICAL CONNECTOR

[76] Inventors: Edward F. Allina, 605 Capri Blvd., Treasure Island, Fla. 33706; Stanley F. Allina, Jr., 9697 Dahlia Ave., Palm Beach Gardens, Fla. 33410

[21] Appl. No.: 749,315

[22] Filed: Aug. 23, 1991

[51] Int. Cl.[5] ..... H01R 33/945

[52] U.S. Cl. ..... 439/517; 439/508; 439/651

[58] Field of Search ..... 439/146, 508, 517, 572, 439/651, 908

[56] References Cited

U.S. PATENT DOCUMENTS

| | | | |
|---|---|---|---|
| 2,606,232 | 8/1952 | St. John | 439/508 |
| 4,892,485 | 1/1990 | Patton | 439/517 |
| 4,944,692 | 7/1990 | Allina | 439/517 |
| 5,033,973 | 7/1991 | Pruehs et al. | 439/517 |

*Primary Examiner*—Paula A. Bradley
*Attorney, Agent, or Firm*—Charles A. McClure

[57] ABSTRACT

Plug-and-jack electrical connector terminal with a blade-like plug terminal portion at one end and a slit-like jack terminal portion at the opposite end. The respective connector portions have at their mutually interconnecting ends preferably flat surfaces adapted to be juxtaposed to one another and to be interconnected, preferably disengageably, by fastener means preferably through bores therein.

14 Claims, 3 Drawing Sheets

FIG. 1A
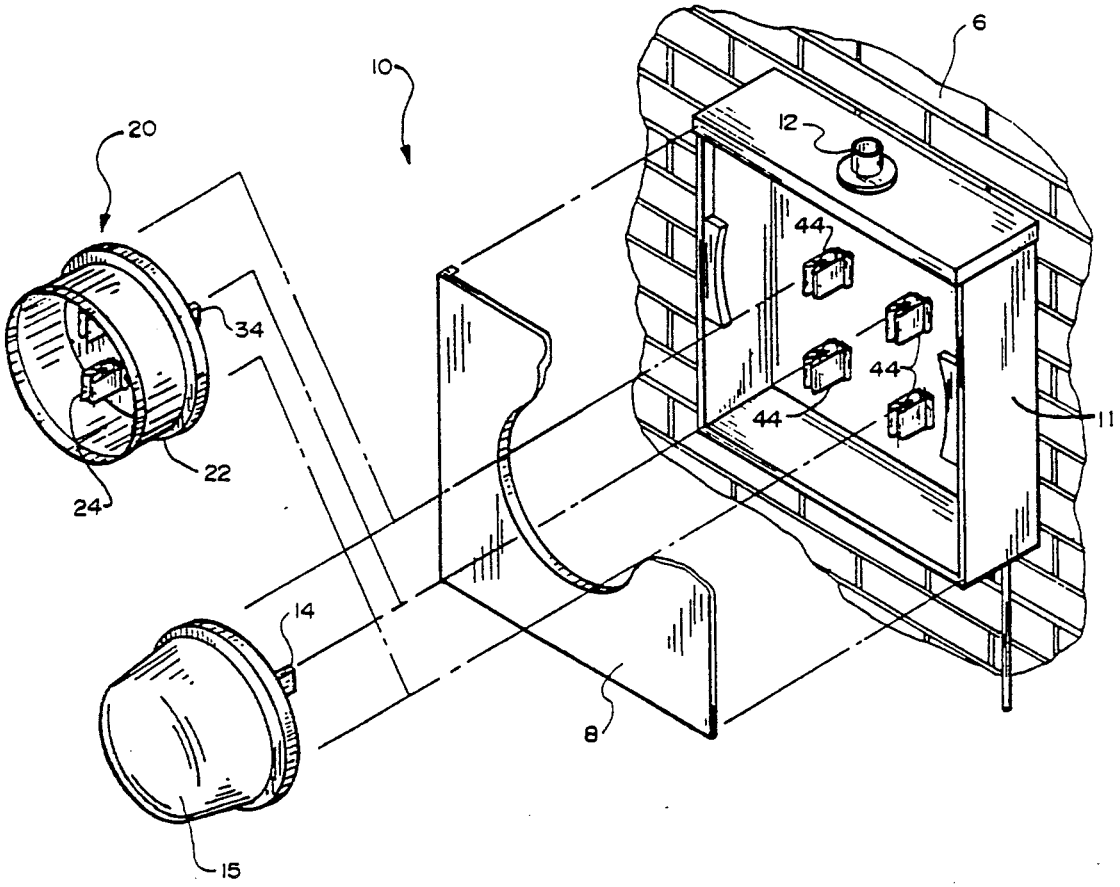
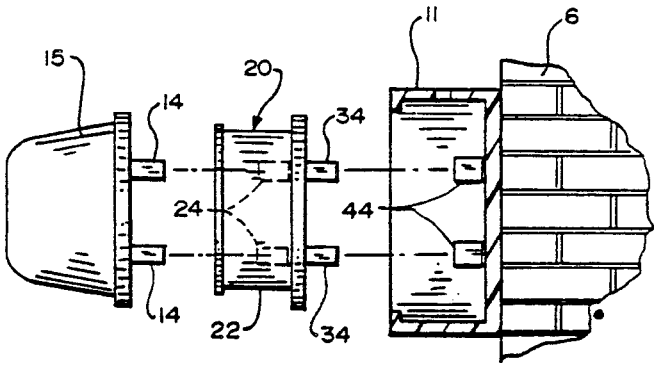
FIG. 1B

FIG. 6A
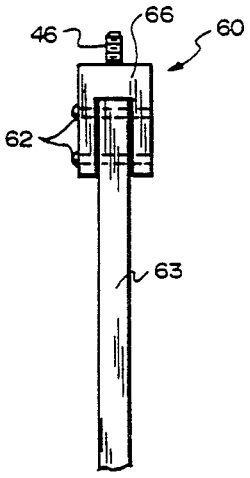
FIG. 6B
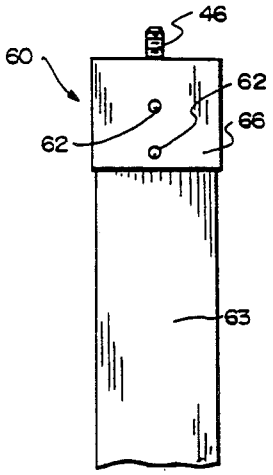
FIG. 7A
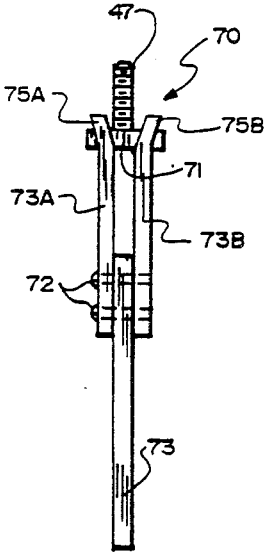
FIG. 7B
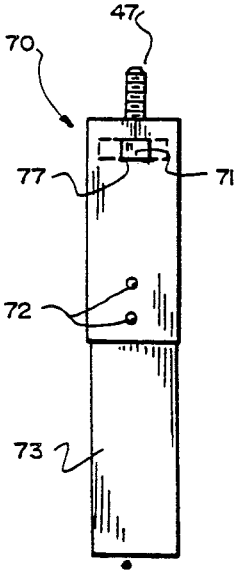
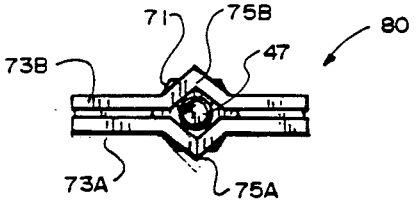
FIG. 7C

PLUG-AND-JACK ELECTRICAL CONNECTOR

TECHNICAL FIELD

This invention relates to plug-and-jack electrical connectors adapted to be interposed between separable plug and jack units.

BACKGROUND OF THE INVENTION

Nearly every household provided with electrical service has, at a service entryway, a watt-hour meter for monitoring the consumption of electrical energy in the household. A principal requirement there is positive electrical contact between the meter and its socket, which may be located in a service panel or the like. Now plug-and-jack adapters with transient voltage surge suppression (TVSS) means are being interposed between the meter and its socket for protection of downstream electrical equipment as well as meters themselves. Such meter adapters, into which the watt-hour meter now plugs, plug into the conventional meter socket in like manner.

Straight blade-like or spade terminals protruding from the base of the meter housing slidably engage receptive socket jaws within such a panel—or now within such a meter adapter. Jaw improvements exemplified in a unitary terminal having the blade-like plug portion at its one end and the complementary jaws of the jack portion at its opposite end were suggested in Allina U.S. Pat. No. 4,944,692. Use of the same or similar constructions in non-unitary connector terminals is likewise beneficial and suggests other improvements. The present invention is directed particularly to assembled electrical plug-and-jack connectors, with interchangeable plug and jack terminals.

SUMMARY OF THE INVENTION

In general, the objects of the present invention are attained, in a plug-and-jack electrical connector, having at one end a blade-like plug terminal portion adapted to fit removably between jaws of a complementary jack, and having at an opposite end thereof a slit-like jack terminal portion with jaws adapted to accommodate a like blade-like plug terminal.

In one embodiment the plug connector has a substantially T-shaped blade-like terminal portion with its T-stem adapted to fit removably between jaws of a separate jack, and with its T-bar adapted to be interconnected to the base of a jack terminal portion aligned with it but directed oppositely from it.

Such electrical connector terminal includes fastener means interconnecting together the opposite ends, remote from the respective plug and jack ends, of the respective portions, with the plug and jack ends in mutual alignment.

A primary object of the present invention is a plug-and-jack connector made up of separable plug and jack portions.

Another object of this invention is to provide such a connector with juxtaposable ends and fastener means to hold them together.

A further object is to provide secondary terminals on one side the portions of such a terminal.

Yet another object of this invention is to provide such a plug terminal with one or more secondary terminals protruding therefrom.

A still further object of the invention is to provide a family of such connectors with interchangeable plug and jack terminals.

Other objects of the present invention, together with means and methods for attaining the various objects, will be apparent from the following description and accompanying diagrams of preferred embodiments, which are presented by way of example rather than limitation.

SUMMARY OF THE DRAWING

FIG. 1A is an exploded perspective view of a watt-hour meter and a wall panel containing a socket to accommodate the meter, also a cylindrical housing with plug-and-jack connector terminals adapted to be interposed between the meter and its socket; and FIG. 1B is an explode side elevation similar to FIG. 1 with a meter adapter interposed between the watt-hour meter and its socket, shown partly sectioned away.

FIG. 6A is an edge elevation of a second embodiment of the plug terminal portion of FIG. 1 with fastener means;

FIG. 6B is a side elevation of the plug embodiment of FIG. 6A.

FIG. 7A is an edge elevation of a third embodiment of the plug terminal portion of FIG. 1 with fastener means;

FIG. 7B is a side elevation of the plug embodiment of FIG. 7A.

FIG. 7C is a top plan of the plug embodiment of FIGS. 7A, 7B.

DESCRIPTION OF THE INVENTION

Figure 2:
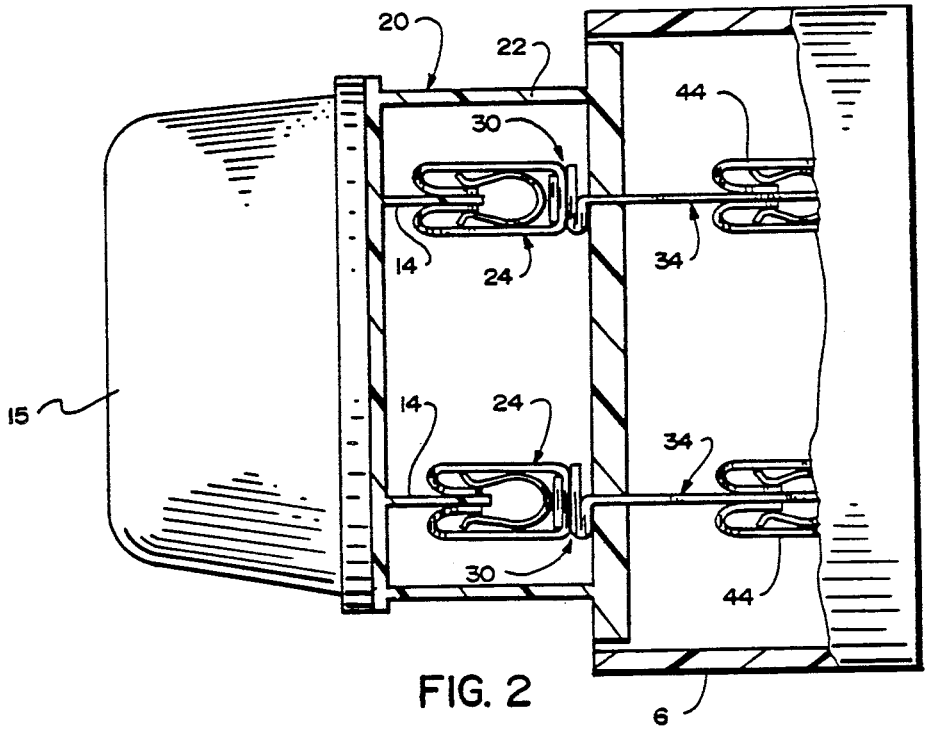
FIG. 2 is an edge elevation, partly in section, of a plug-and-jack arrangement in a meter adapter of the previous views.

FIGS. 1A and 1B show, in exploded respective perspective and side elevation, electrical apparatus 10 featuring box or panel 11 rear-mounted on brick wall 6 an with open fitting 12 at its top to admit external electrical power source input leads (not shown here).

This panel supports inside at its back wall a quartet of conducting jawlike jacks 44 in socket configuration and connected in pairs to the input power leads leads (not shown). The panel is uncovered at the side to receive in the socket jacks a complementary set of bladelike plug-in terminal ends 14 protruding from watt-hour meter 15, which itself may be wholly conventional.

Intervening cover 8 (partly cut away, FIG. 1A only) fits about the meter housing—and when closed over the panel covers the surrounding side part thereof. The meter fits within and closes the opening in the central part of the cover when plugged into the socket jacks. At the upper left in FIG. 1A is meter adapter 20, laterally offset from the meter-to-socket axis. As suggested by the right-angle zigzag broken lines, adapter 20 is interposable onto such axis between the meter and the panel. FIG. 1B shows meter 15 and panel 11 aligned horizontally, with meter adapter 20 intervening. The meter adapter 20 has cylindrical housing 22, with an opening end containing jack jaws 24, corresponding to panel jack terminal jaws 44 and adapted to receive plug terminal blades 14 from the meter when so interposed. Protruding from the adapter's closed opposite end are blades 34 corresponding to meter blades 14 and similarly adapted to plug likewise into panel socket jacks 44.

FIG. 2 shows the components of the preceding views assembled: meter 15 at the left, panel 11 at the right, and meter adapter 20 in between. Part of the panel is cut away to reveal the interior, as is all of the near wall of the adapter housing, and the cover is omitted to simplify this view. Shown here are plug portion 34 and jack portion 24 of pair of assembled plug-and-jack terminals 30 in the adapter housing. The respective portions are fastened together along their respective juxtaposed flat end parts in any suitable manner (e.g., welded) but preferably are engaged disengageably with the aid of a separate fastener as below. Bladelike ends 14 of the meter terminals are shown engaged in meter adapter terminal jacks 24, with the bladelike ends 34 of the adapter terminals engaged with panel jacks 44. The jacks in both the panel socket and the adapter housing may be identical (though designated by diverse reference numerals here) and appear in the next view.

Figure 3A:
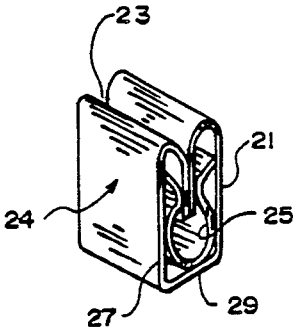
FIG. 3A (PRIOR ART)
FIG. 3A is a perspective view of the jack terminal (prior art) of FIG. 2.

FIG. 3A shows jack portion 24 (prior art) of the electrical connector in perspective. It has three major components: (i) external strip 21 folded into U-form with flat base 29, and with the arms of the U turned inward along and against one another and back toward the base to form slit 23 therebetween; (ii) lyre-like spring 25 receiving the incurved ends of strip 21 within the neck of the lyre; and (iii) flat insert 27 between the inside surface of the base and the outside curved bottom surface of the lyre. The insert is bored centrally and is threaded to receive therein threaded fastener means such as the bolt, screw, or stud examples shown in subsequent views.

Figure 3B:
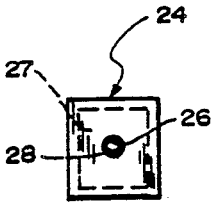
FIG. 3B (PRIOR ART)
FIG. 3B is a bottom plan of the jack embodiment of FIG. 3A.

FIG. 3B shows jack terminal portion 24 in bottom plan, with unthreaded central bore 28 therein. Slightly smaller threaded central bore 26 in insert 27 (indicated in broken lines) is visible through bore 28 in position to receive and retain a threaded plug member.

Figure 4A:
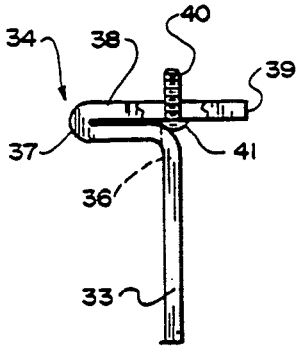
FIG. 4A is an edge elevation of the plug embodiment of FIG. 2.
Figure 4B:
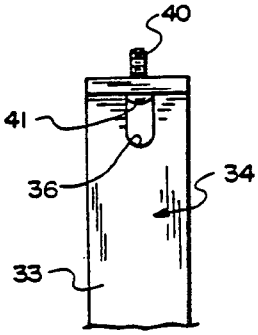
FIG. 4B is a side elevation of the plug embodiment of FIG. 4A.

FIGS. 4A and 4B show plug terminal portion 34 in respective edge and side elevations, from which its T-shaped outline is seen. Blade part 33 constitutes the T-stem, and perpendicular head part 38 constitutes the T-bar. The T-bar and the T-stem preferably comprise a single strip folded perpendicularly at the top of the T-stem away from and then back on itself at curved left edge 37 of the T-bar toward and across to terminate at right edge 39 of the stem. Central bore through the T-bar, in line with the T-stem, receives fastener 40 upward therethrough with its threaded end protruding away from the T-stem. Head 41 of the fastener is accommodated by opening 36 through the T-stem portion at and near the T-bar junction.

It will be understood that in the assembled form of terminal 30 the flat top of the plug portion and the flat bottom of the jack portion remote from their respective opposite ends are juxtaposed (as in FIG. 2) and are retained together, preferably disengageably. In the illustrated disengageable embodiment of jack 24, a bolt or screw type of fastener passes through central bottom bore 28 and threads into aligned threaded bore 26 in insert 27, holding the respective plug and jack portions securely together and in mutual alignment.

Figure 5A:
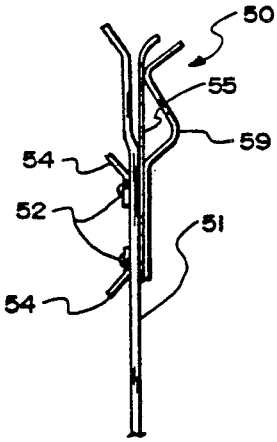
FIG. 5A is an edge elevation of another jack embodiment.
Figure 5B:
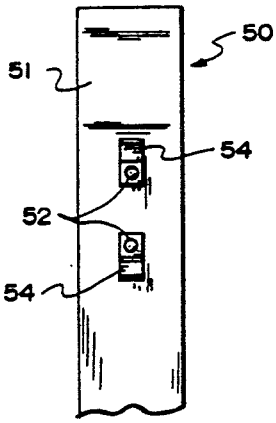
FIG. 5B is a side elevation of the jack embodiment of FIG. 5A.

FIGS. 5A and 5B show from the edge and side, respectively, an alternative jack embodiment 50, which lacks the incurved jaws of the previous embodiment. This embodiment is composed of long main strip 51 and shorter strips 55 and 59, all retained permanently together by pair of rivets 52, each of which also retains against the outside surface of strip 51 a secondary terminal in the form of a short narrow piece riveted at one end and protruding obliquely outward at its opposite end 54 onto which suitable connectors can be pressed.

In this jack main strip 51 is the principal structural element, and is rigid but offset outward to the left in FIG. 5) by the width of a terminal blade to be received by the jack. Zigzag outer strip 59 is springy, being designed to compress the jack against an inserted plug terminal. Strips 51 and 59 flare apart at their outer ends to assist in directing an inserted blade between them. Intermediate strip 55 is substantially straight, with a slight flare in the spring strip direction, and assures a broad area of contact that the spring strip cannot supply by itself.

The subsequent diagrams illustrate a pair of additional plug terminal embodiments: plug 60 in edge and side elevations in FIGS. 6A and 6B; plug 70 in edge and side elevations in FIGS. 7A, 7B, and 7C.

FIGS. 6A and 6B show plug embodiment 60 in respective edge and side views, featuring straight blade portion 63 (partly cut away) topped by inverted U-shaped member 66 retained by pair of rivets 62 as fasteners through both legs of the U-member and through intervening blade 63 flanked thereby in partly overlapping relationship. Threaded stud 46 extends up from the inverted base of the U-member and is thereby adapted to secure this plug terminal portion to a suitable jack portion selected to complete a plug-and-jack.

FIGS. 7A, 7B, and 7C show plug embodiment 70 in similar views of the edge and side, and a top plan. The U-member of the preceding pair of views is replaced here by a pair of side members similar to blade member 73, retained in partially overlapping relationship therewith by pair of fastening rivets 72. The non-overlapping ends of these side members are correspondingly spaced apart, and each is slotted near the top and is flared outward nearly square in plan from about the slot to the top. More particularly, the corners of bolt head 71 fit in slot 77, and threaded length 47 of the bolt fits within flared top portions 75A and 75B. The threaded part of the bolt is adapted to fit into a threaded bore in a jack member, upon assembly into a complete plug-and-jack terminal. Whereas rivets 82 pass through both parts of the resulting blade, other fastening means, such as an alloying coating therebetween, may be used also.

Here each of the rivets also retains a secondary terminal in the form of a short narrow piece riveted at one end and protruding obliquely outward at its opposite end 84 onto which suitable connectors can be pressed, much as onto the jack portion illustrated in FIGS. 5A and 5B.

Both conventional and novel embodiments of jack terminal portions, as well as several variants of plug terminal portions, of a composite plug-and-jack terminal connector have been illustrated and described to show the versatility of this invention. Additional features, such as secondary terminals, have been shown on some and can be provide in similar manner on any of the others, if desired. They do not require any unusual materials of construction but may be made of a wide variety of metals having adequate structural strength and electrical conductivity, as will be apparent to persons skilled in the art of electrical connectors.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

We claim:

1. Plug-and-jack electrical connector terminal, comprising a blade-like plug terminal portion at one end adapted to fit removably between jaws of a complementary jack;

a slit-like jack terminal portion at an opposite end thereof having jaws adapted to accommodate a like blade-like plug terminal;

interconnected in oppositely directed alignment, being thereby adapted to be interposed between like separable plug and jack units, and disengageable fastener means connecting the respective plug and jack terminal portions at interconnecting end surfaces thereof remote from the blade-like plug end and the slit-like jack end respectively, thereby enabling interconnected ends of the respective terminal portions to be disconnected.

2. Plug-and-jack electrical connector terminal, comprising a blade-like plug terminal portion at one end adapted to fit removably between jaws of a complementary jack;

a slit-like jack terminal portion at an opposite end thereof having jaws adapted to accommodate a like blade-like plug terminal;

wherein the blade-like terminal portion is T-shaped in outline, with its T-stem including the blade-like plug terminal end, and with its T-bar having a flat top surface adapted to interconnect with a flat end surface of the interconnecting end of the jack terminal portion and being bored to admit the connecting fastener means interconnected in oppositely directed alignment, being thereby adapted to be interposed between like separable plug and jack units, and fastener means connecting the respective plug and jack terminal portions at interconnecting end surfaces thereof remote from the blade-like plug end and the slit-like jack end respectively.

3. Plug-and-jack electrical connector terminal, comprising a blade-like plug terminal portion at one end adapted to fit removably between jaws of a complementary jack;

a slit-like jack terminal portion at an opposite end thereof U-shaped in outline, with a flat bottom surface on its U-base adapted to interconnect with a flat top end surface of the interconnecting end of the plug terminal portion, having jaws adapted to accommodate a like blade-like plug terminal, and being bored to admit the connecting fastener means;

interconnected in oppositely directed alignment, being thereby adapted to be interposed between like separable plug and jack units, and fastener means connecting the respective plug and jack terminal portions at interconnecting end surfaces thereof remote from the blade-like plug end and the slit-like jack end respectively.

4. Plug-and-jack electrical connector terminal comprising a blade-like plug terminal portion T-shaped in outline, with its T-stem adapted to fit removably between jaws of a complementary jack, and with its T-bar having a flat top surface;

a slit-like jack terminal portion U-shaped in outline, with its U-shaped jaws adapted to accommodate a like blade-like plug terminal therebetween, and with its U-base having a flat bottom surface;

the respective flat surfaces being adapted to be juxtaposed to one another and being bored to admit interconnecting fastener means; and disengageable interconnecting fastener means, thereby enabling disconnection of the respective terminal portions from one another.

5. Plug-and-jack electrical connector terminal comprising a blade-like plug terminal portion T-shaped in outline, with its T-stem adapted to fit removably between jaws of a complementary jack, and with its T-bar having a flat top surface; and a slit-like jack terminal portion U-shaped in outline, with its U-shaped jaws adapted to accommodate a like blade-like plug terminal therebetween, and with its U-base having a flat bottom surface;

the respective flat surfaces being adapted to be juxtaposed to one another and being bored to admit interconnecting fastener means, wherein the U-base of the jack terminal also has a flat upper surface, and including a flat insert located against that flat upper surface and bored to admit the interconnecting fastener means.

6. Plug-and-jack electrical connector terminal comprising a blade-like plug terminal portion T-shaped in outline, with its T-stem adapted to fit removably between jaws of a complementary jack, and with its T-bar having a flat top surface; and a slit-like jack terminal portion U-shaped in outline, with its U-shaped jaws adapted to accommodate a like blade-like plug terminal therebetween, and with its U-base having a flat bottom surface;

the respective flat surfaces being adapted to be juxtaposed to one another and being bored to admit interconnecting fastener means, wherein at least one of the bored components is threaded internally to thread onto complementary externally threaded fastener means.

7. Plug-and-jack electrical connector terminal, comprising at one end of a blade-like plug terminal portion adapted to fit removably between jaws of a complementary jack; interconnecting at an opposite end thereof a slit-like jack terminal portion having jaws adapted to accommodate a like blade-like plug terminal;

wherein an intermediate surface of the blade-like terminal has thereon protruding in a generally lateral direction therefrom at least one terminal member adapted to receive a press-on connector.

8. Plug-and-jack terminal according to claim 7, including a pair of such protruding terminal members on the blade-like terminal.

9. In a plug-and-jack terminal electrical connector terminal having a separable blade-like plug terminal portion and a slit-like jack terminal portion, the improvement comprising a substantially T-shaped blade-like terminal portion with its T-stem adapted to fit removably between jaws of a separate jack, and with its T-bar adapted to be interconnected to the base of a jack terminal portion aligned with it but directed oppositely from it.

10. Plug-and-jack terminal according to claim 9, wherein the T-bar is symmetrically dimensioned at both sides of the T-stem.

11. Plug-and-jack terminal according to claim 9, wherein the T-bar is asymmetrically dimensioned from side-to-side of the T-stem.

12. Plug-and-jack terminal according to claim 9, wherein the T-bar has a single thickness throughout the T-stem and at one side of the T-stem but double thickness at the other side of the T-stem.

13. Plug-and-jack terminal according to claim 12, wherein the double-thickness part is located between the T-stem and the single-thickness part of the T-bar and is made up of an intervening single-thickness part folded back onto itself.

14. Plug-and-jack terminal according to claim 13, wherein the T-bar has at least one bore therein to accommodate fastener means, and the bore extends through an adjacent part of the T-stem so as to enable the fastener means to be inserted into the bore in the T-bar.

* * * * *